US007194967B2

(12) United States Patent
Bowlus

(10) Patent No.: US 7,194,967 B2
(45) Date of Patent: Mar. 27, 2007

(54) EMBROIDERY PATCH PLACEMENT HOLDER

(76) Inventor: Monier Bowlus, 1117 Stapleton La., Flower Mound, TX (US) 75028

( * ) Notice: Subject to any disclaimer, the term of this patent is extended or adjusted under 35 U.S.C. 154(b) by 32 days.

(21) Appl. No.: 11/142,222

(22) Filed: Jun. 1, 2005

(65) Prior Publication Data

US 2006/0272565 A1 Dec. 7, 2006

(51) Int. Cl.
*D05C 9/04* (2006.01)

(52) U.S. Cl. ..... 112/103; 38/102.2

(58) Field of Classification Search ..... 112/103, 112/119, 470.14, 475.18, 475.22, 439; 160/374.1, 160/380; 38/102.2
See application file for complete search history.

(56) References Cited

U.S. PATENT DOCUMENTS 3,664,288 A * 5/1972 von Boden et al. ..... 112/103
3,886,990 A * 6/1975 Campione ..... 160/374.1
4,762,076 A * 8/1988 Wakaizumi ..... 112/103
5,144,899 A * 9/1992 Allen ..... 112/103
5,546,877 A * 8/1996 Moore ..... 112/103
6,109,194 A * 8/2000 Farb ..... 112/103
6,640,735 B2 * 11/2003 Kwang ..... 112/475.18

* cited by examiner

*Primary Examiner*—Ismael Izaguirre
(74) *Attorney, Agent, or Firm*—Christopher P. O'Hagan; David W. Carstens; Carstens & Cahoon, LLP

(57) ABSTRACT

The present invention provides a placement holder for embroidering patches. The placement holder fits inside an embroidery hoop for use in an automated embroidery machine and contains a cutout section in the shape of the patch. The patch is placed inside the cutout section of the holder, which aligns the patch with the needles of the embroidery machine. The placement holder allows the patch to be properly aligned without the need for making a running stitch and securing the patch within the bounds of the running stitch with adhesives.

26 Claims, 9 Drawing Sheets

EMBROIDERY PATCH PLACEMENT HOLDER

TECHNICAL FIELD

The present invention relates generally to embroidery machinery and more specifically to an apparatus for securing patches (badges) in place in a machine without the need for adhesive chemicals or adhesive backings.

BACKGROUND OF THE INVENTION

Though modern machinery has largely automated the process of embroidering clothing and patches, current embroidery methods still require a considerable amount of user input. This not only increases the time requirement for the embroidery process but also leaves opportunities for human error and increased equipment maintenance. In addition, current embroidery methods involve the use of adhesive chemicals, adding to the cost of production and exposing some users to potential harmful chemicals.

FIG. 1 shows a typical embroidery machine well known in the art. This particular machine 100 is configured to embroider patches. Using a series of needles 101, each with its own thread, the machine 100 embroiders patches held in the center of a plastic hoop 102 that is secured to the frame of the machine.

FIG. 2 shows a closer view of an embroidery hoop 102. In this view one can see the tear away backing material 201 that is secured to the hoop 102. This tear away material 201 is used to mount patches during the embroidery process.

Some machines are capable of holding multiple hoops and embroidering several patches at once. In addition, the size and shape of the hoop may also vary. However, the operation of these different machines works along the same lines.

A pattern to be embroidered must first be created by a digitizer. A digitizer is a person who by means of a computer converts a design to stitches in a format that the embroidery machine can understand. The design to be digitized can be a computer image file of various formats, or it can be on printed paper or in the imagination of the digitizer. Once the digitized design is completed, the operator of the embroidery machine uploads the digitized design into the embroidery machine, in some cases the design is transferred to the embroidery machine little by little through a network cable during the stitching process.

The pattern to be embroidered onto the patch is stored electronically in a component of the embroidery machine. In preparation for embroidering on a blank patch, the first step after inserting the hoop into the machine is to have the machine make a "running stitch" outline in the shape of the patch on the backing material which is secured to the hoop, as shown in FIG. 3. This running stitch 301 defines the outside border of the patch to be embroidered. For purposes of illustration, the running stitch 301 depicted in FIG. 3 is circular. However, the running stitch may be of any shape, depending on the outline of the patch in question. The person designing the embroidery pattern must know the size and shape of the patch to be embroidered, as the embroidery design is constrained by the size and shape of the running stitch.

After the embroidery machine makes the running stitch outline in the backing material, the embroidery machine must be stopped. The user then applies an adhesive spray 302 to the backing material or to the back of the blank patch and places the blank patch (not shown) within the outline of the running stitch 301. The embroidery machine is then restarted, and the automated embroidery process continues until the embroidered pattern in finished. After the embroidery design is finished, the patch is simply torn away from the backing material, often taking some of the material with it.

As an alternative to the tear away backing and spray-on adhesive, a self-adhesive, tear-away paper backing can be used in the hoop to secure the blank patch in place. However, the general process is virtually the same. In this case, the backing is removed to expose the adhesive, either before or after the running stitch has been made by the machine and the blank patch is placed onto the exposed adhesive paper within the running stitch outline.

The current approach described above has several disadvantages. Because the running stitch must be made in the backing material before the blank patch can be put into place, the machine has to be started and then stopped while the adhesive is applied (or backing pealed away to expose self-adhesive paper). These steps take up to a minute or two per patch, which can add up to significant time costs when producing large batches.

Though aligning the patch within the outline of the running stitch is fairly simple, there is the possibility of human error, resulting in misalignment of the embroidery design on the patch. The adhesive itself may also be insufficient to prevent the patch from shifting during the embroidery process.

The spray-on adhesive can also interfere with the operation of the embroidering machine as the adhesive has a tendency to build up on the sewing needles and can even cause threads to break, requiring the machine to be stopped and the needles rethreaded. The cumulative cost of the spray-on adhesive or self-adhesive paper also contributes considerably to the cost of production.

Therefore, it would be desirable to have a method for properly securing patches in the embroidering machine without the need for making a running stitch and then stopping the machine and without the need for applying adhesive chemicals or expensive self-adhesive backings to secure the patch and reduce the likelihood of human error in the placement of the patch.

SUMMARY OF THE INVENTION

The present invention provides a placement holder for embroidering patches. The placement holder fits inside an embroidery hoop for use in an automated embroidery machine and contains a cutout section in the shape of the patch. The patch is placed inside the cutout section of the holder, which aligns the patch with the needles of the embroidery machine. The placement holder allows the patch to be properly aligned without the need for making a running stitch and securing the patch within the bounds of the running stitch with adhesives.

The patch holder may include marking to indicate proper alignment within the embroidery hoop. Alternatively, the patch holder may have a locking mechanism to hold it in place within the hoop or be manufactured as part of the hoop.

Patches are held in place within the cutout section of the patch holder by locking stitches that secure the patch to a backing material placed within the embroidery hoop. These locking stitches are incorporated into the embroidery design and are made first before the rest of the design is stitched into the patch. The locking stitches can scale with the embroidery design, thus enabling the patch holder to be used with any embroidery manufacturer's digitizing software and design format.

The patch holder can be used with both industrial and home machines, and multiple patch holders can be used on multi-hoop embroidery machines, allowing embroidery on multiple patches simultaneously. In addition, multiple patches can be incorporated into a single embroidery patch holder allowing the embroidery machine to stitch out several patches within a single hoop.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
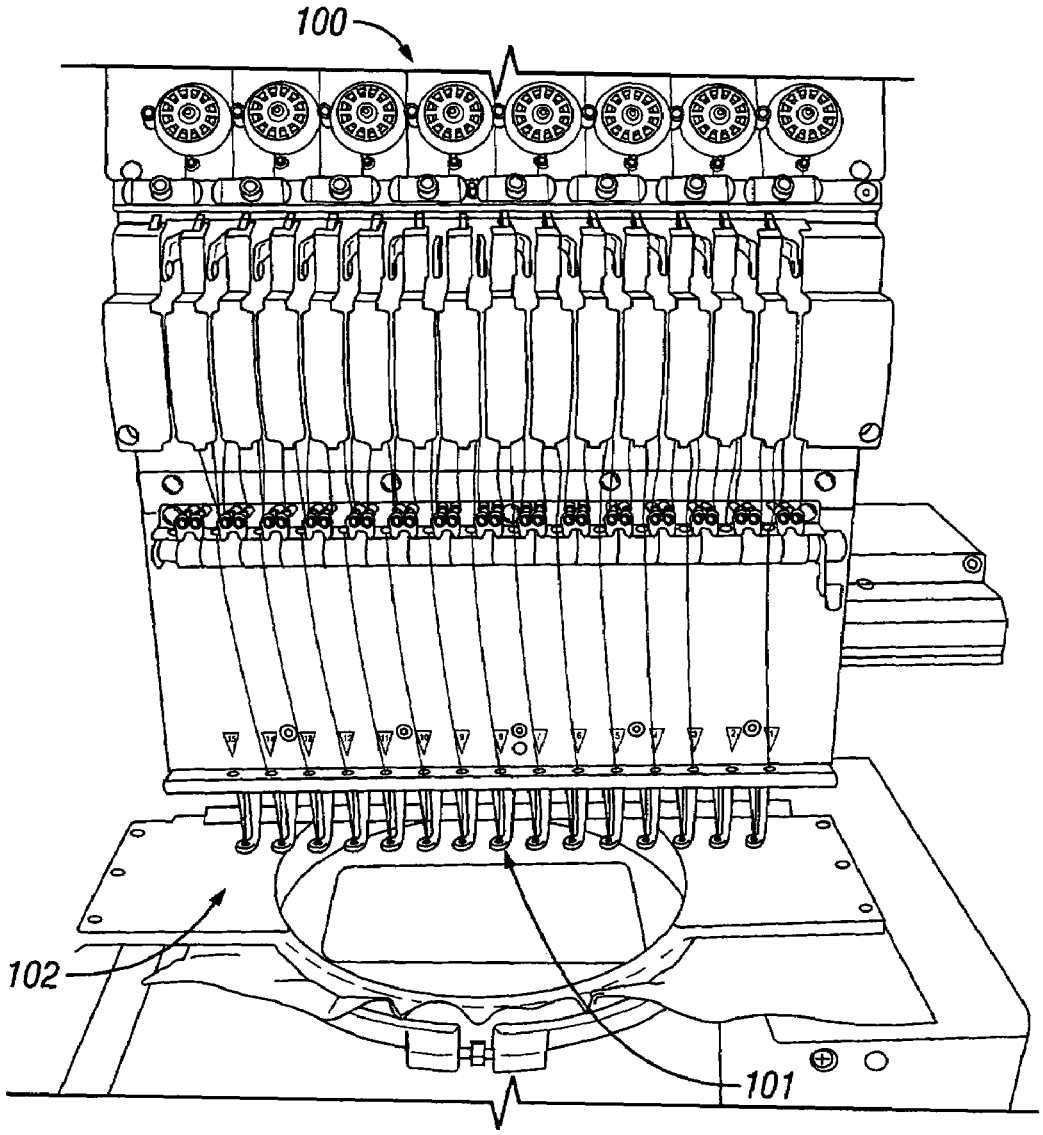
FIG. 1 (Prior Art)
FIG. 1 shows a typical embroidery machine well known in the art.
Figure 2:
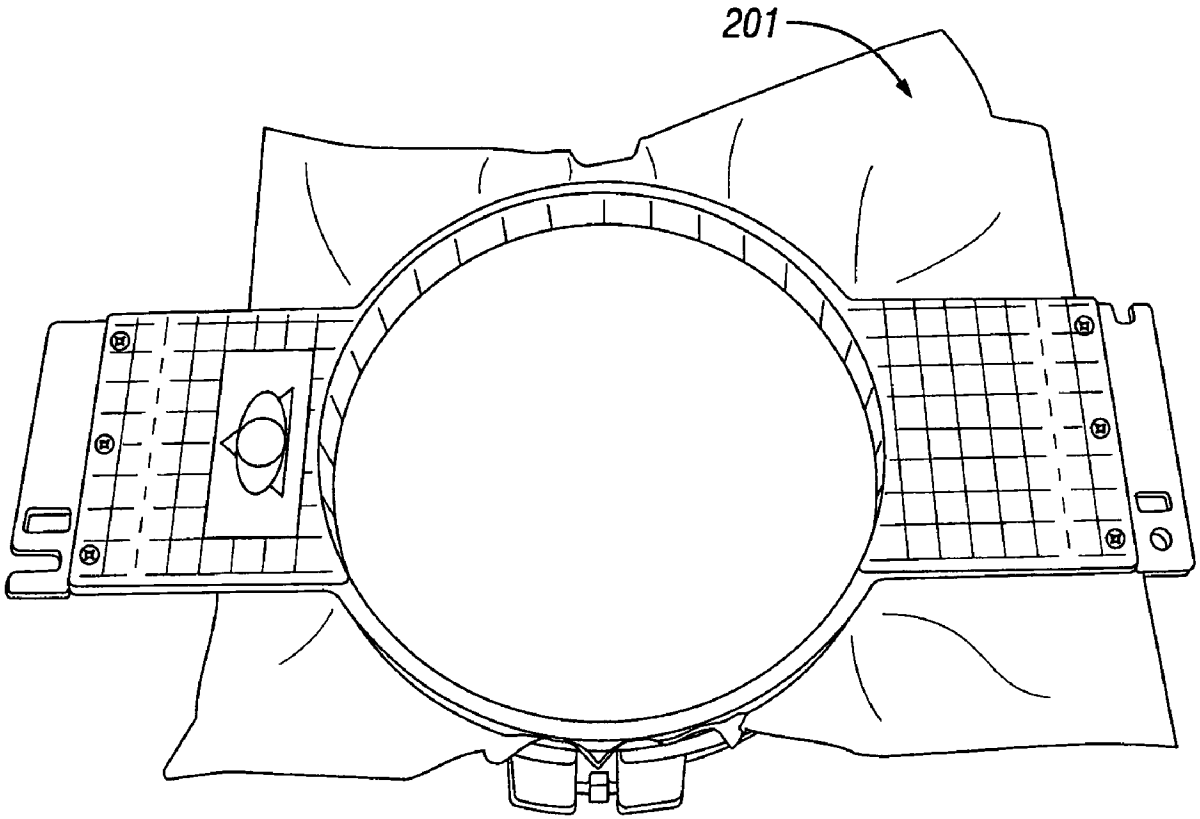
FIG. 2 (Prior Art)
FIG. 2 shows a closer view of a hoop used to hold a patch in place for the embroidery machine.
Figure 3:
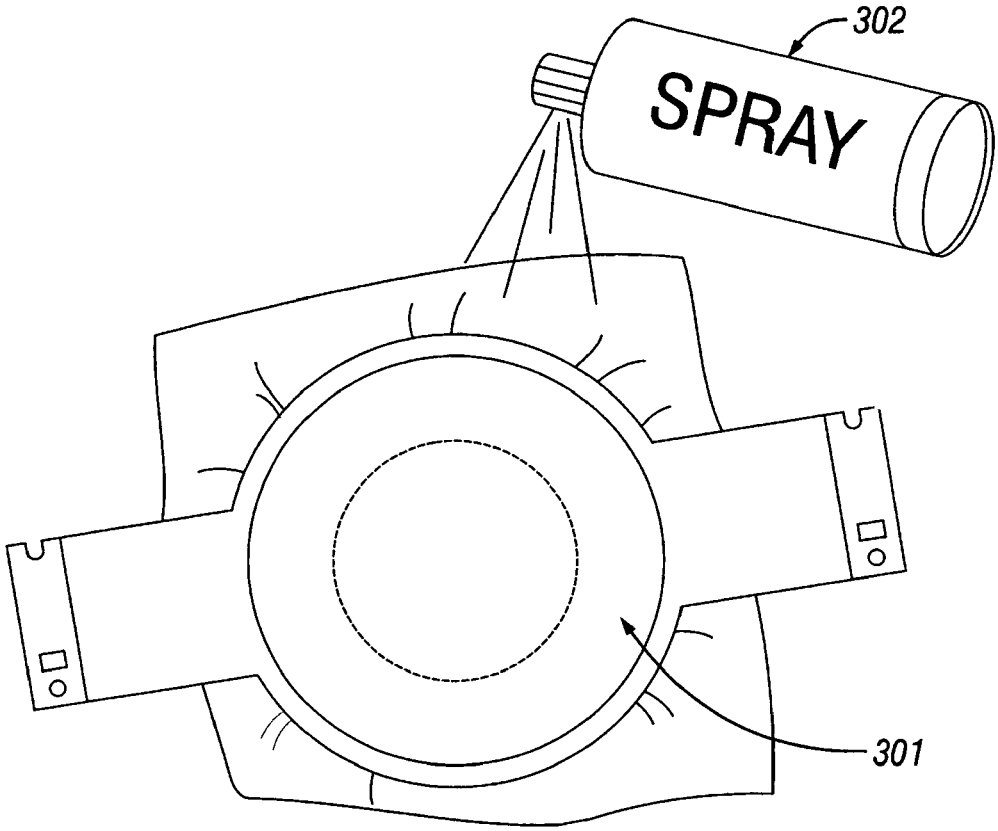
FIG. 3 (Prior Art)
FIG. 3 shows a running stitch and adhesive used to secure patches to the backing material in the hoop.
Figure 4:
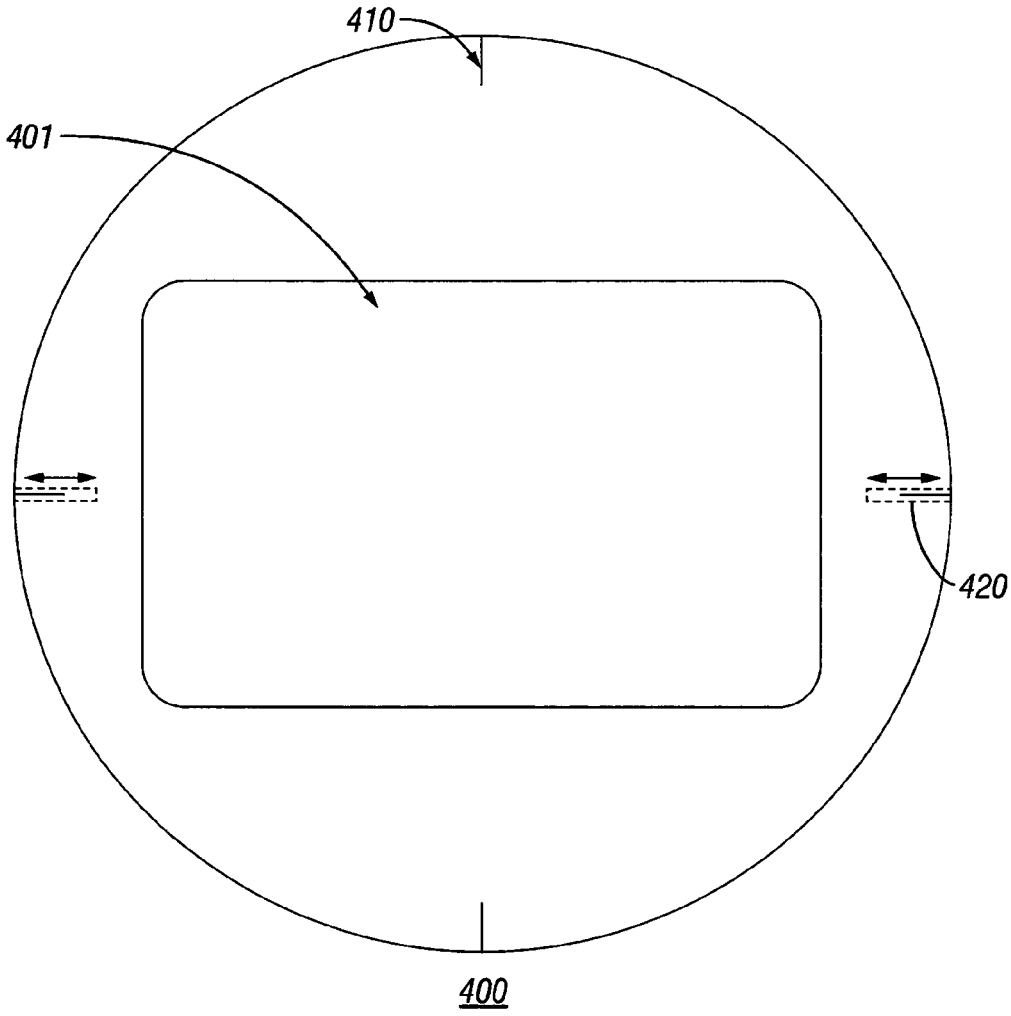
FIG. 4 shows one type of an embroidery patch placement holder in accordance with the present invention.

FIG. 4 shows an embroidery patch placement holder in accordance with the present invention. The patch placement holder 400 replaces expensive traditional chemical sprays and adhesive backings used to position blank patches for embroidery. It is a pre-shaped patch template that holds a blank badge in position. The center of the holder 400 has a cut out section 401 in the shape of the outline of the patch. In the present example, the patch shape is a simple rectangle, but the shape can be cut to match any patch shape that can fit within the plastic hoop. In an alternate embodiment (shown in FIG. 5B), the patch holder may also have multiple cut out sections for holding multiple patches within a single hoop.

Figure 5A:
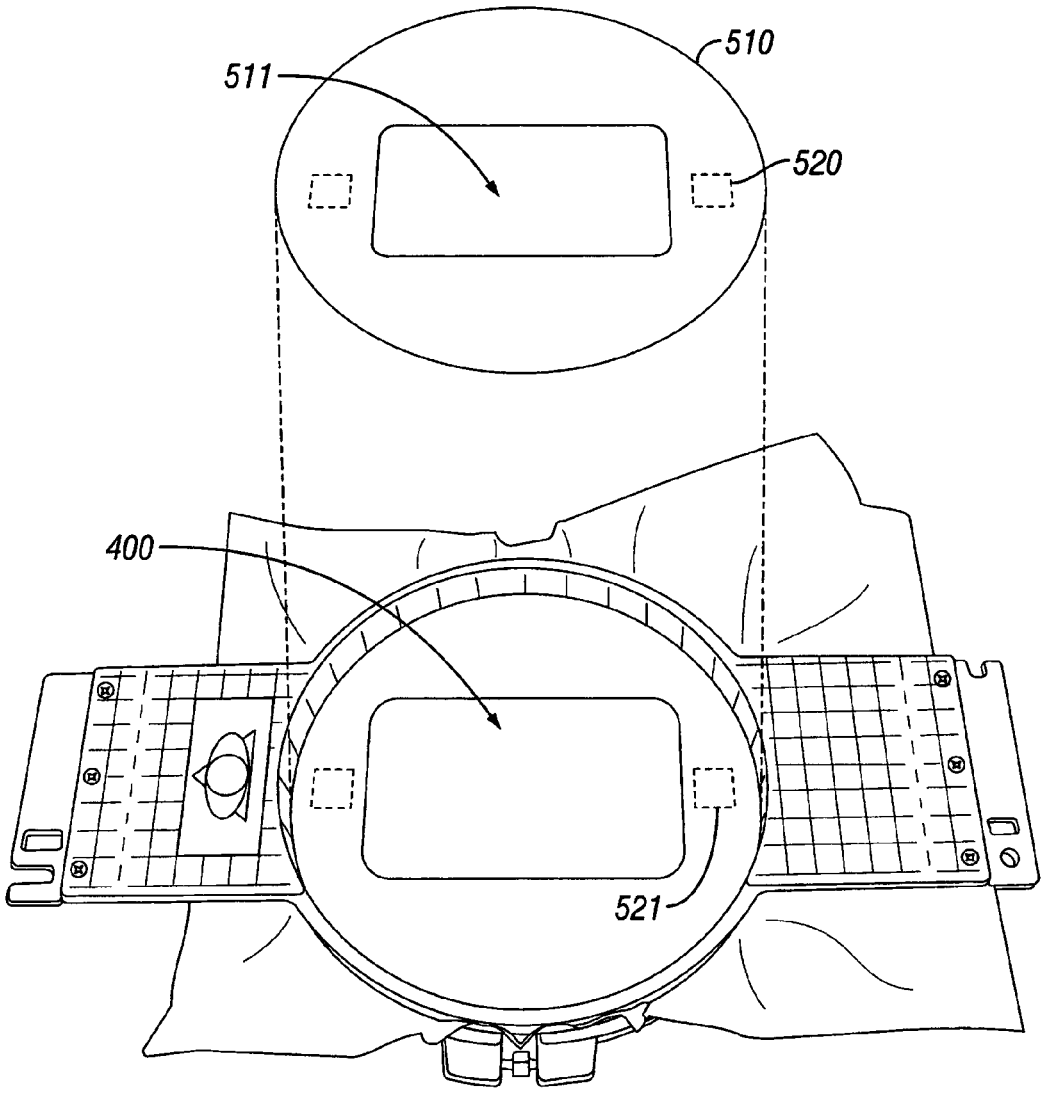
FIG. 5A shows a patch placement holder positioned in an embroidery hoop.
Figure 5B:
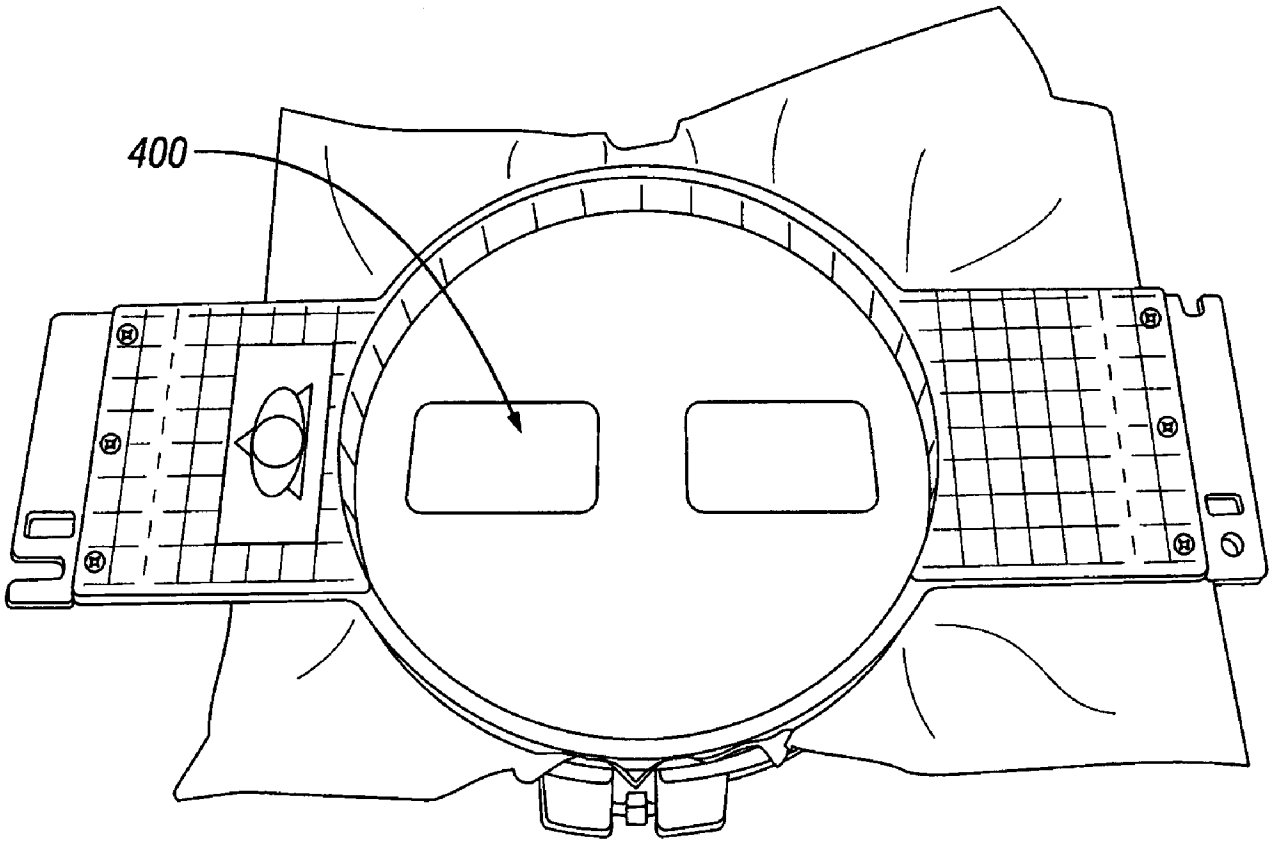
FIG. 5B shows a patch placement holder with multiple cutout sections positioned in an embroidery hoop.

The patch placement holder 400 also has line markings 410, which help the user properly align the holder with the raised grid on the embroidery hoop, as shown in FIG. 5A. This ensures that the embroidery design is properly aligned on the patch. In one embodiment of the invention, a locking mechanism may secure the patch holder to the hoop. The locking mechanism is a small pin 420 that is mounted to the embroidery patch holder. Once the embroidery patch holder is properly aligned within the hoop the pins are pushed into small holes in the hoop, thus aligning and securing the embroidery patch holder to the hoop. In another embodiment of the invention, the patch placement holder is manufactured as part of an embroidery hoop.

Figure 6:
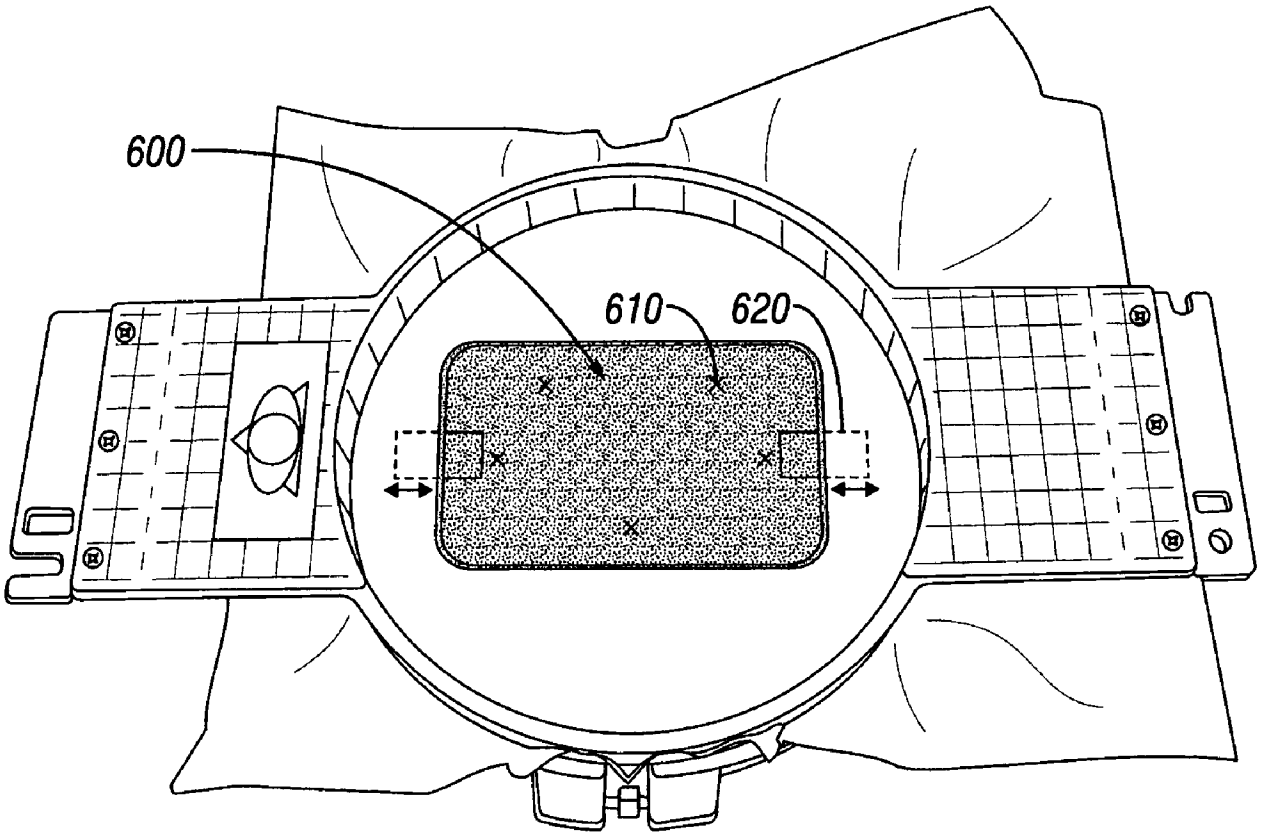
FIG. 6 shows the placement of a blank patch within the embroidery patch placement holder.

FIG. 6 shows a blank patch placed in the embroidery patch placement holder. The shape within the embroidery patch placement holder can be made to fit and shape patch.The digitized design has several "lock stitches" 610 placed underneath the design that secure the patch to the backing material before the design is stitched out. These lock stitches do not require a "stop" command as traditional techniques require. Once the patch is placed in the holder and the embroidery starts, there is no need to stop until the embroidery designed is finished. There is no need to make a running stitch or apply adhesive, as the holder 400 provides the proper positioning and alignment of the patch.

In addition to securing the patch using locking stitches, the embroidery patch holder can incorporate a patch holding lock to further secure the patch to the embroidery patch holder. This might be necessary when stitching out several patches within a single hoop or when patches are warped or curled. The patch locks 620 are simply pieces of metal or like material mounted to the embroidery patch holder. After the blank patch is placed in the embroidery patch holder, the locks are slid over the edge of the patch (approximately 1–10 mm of the patch edge), securing the blank patch against the backing material before the locking stitches are made.

Another securing mechanism for a warped or curled blank patch or multiple patches while embroidery takes place comprises a second layer of material (a securing plate 510) that is placed over the patch holder in the embroidery hoop (see FIG. 5A). Similar to the patch holder, the securing plate 510 has a cutout 511 in the shape of the patch. However, the securing plate has a smaller cutout than the patch holder, so when it is placed on top of the patch and patch holder it overlaps the edge of the patch by 1 mm to 3 mm, securing the patch to the backing material. Very small powerful magnets 520, 521 are embedded within the patch holder and securing plate, thus sandwiching the patches and securing them so they do not move during the embroidery process. This is quick and easy and can increase production with fewer moving parts. This alternate method can even eliminate the need for the lock stitches. However, lock stitches provide additional stability that is preferred.

FIG. 6 shows a blank patch placed in the embroidery patch placement holder. The shape within the embroidery patch placement holder can be made to fit any shape patch.

Figure 7:
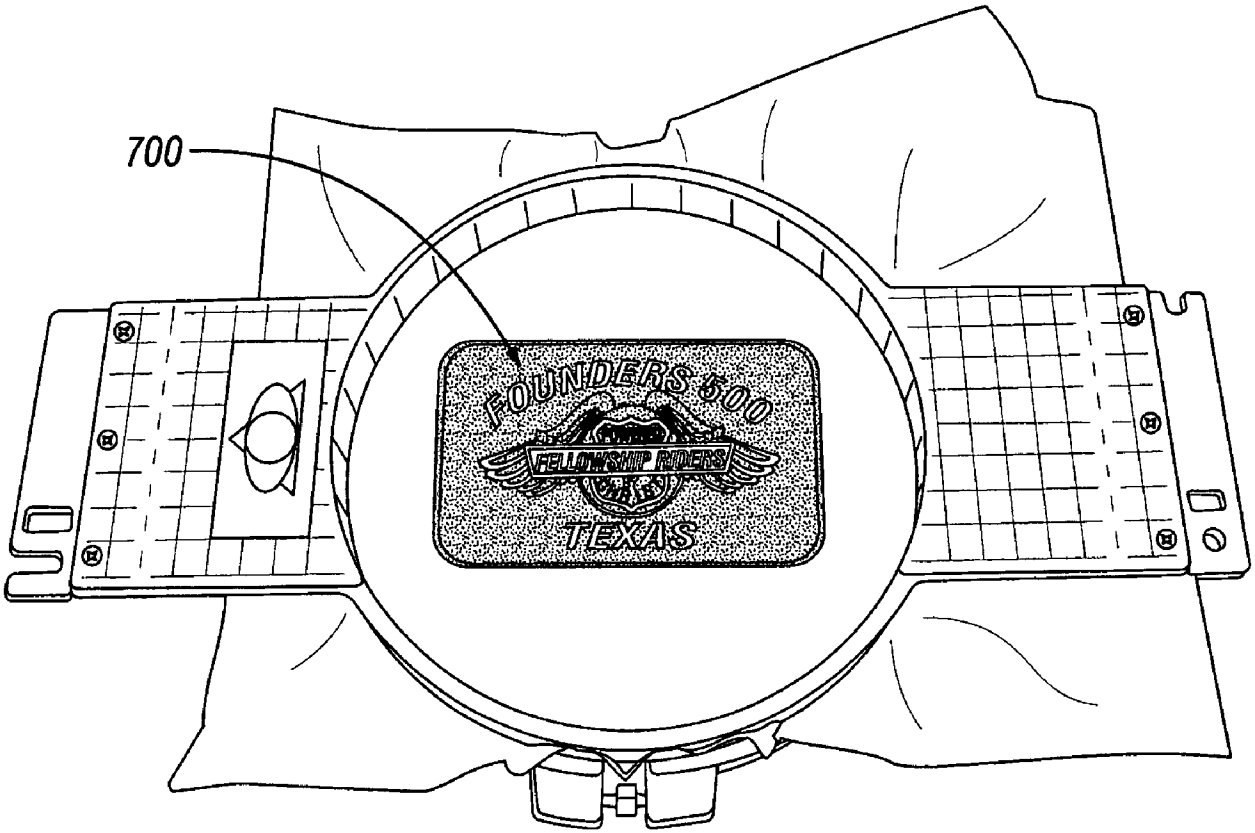
FIG. 7 shows a finished embroidered patch in the placement holder.

FIG. 7 shows a finished embroidered patch 700 in the placement holder.

The patch holder can be made from a variety of inexpensive materials such as plastic, PVC, PVC foamboard (Celtec®), Styrene (vinyl benzene), Polycarve™ (high density polyethylene), acrylic, pressed balsa wood, processed wood materials such as Formica® (plastic laminate) or Masonite® (engineered wood), plexiglass, Lexan® (polycarbonate thermoplastic resin), rigid textile materials, metal, rubber or similar materials. In the preferred embodiment of the invention, the thickness of the holder is approximately equal to that of the patch (1 mm to 5 mm) to prevent snagging by the embroidery needles.

The present invention offers significant time savings, particularly in large batch production. It can be used with both industrial and home embroidery machines. Because the invention completely mechanizes the production process, operators do not have to take time to align each badge with the outline running stitch. The placement holder also takes the guess work out of badge placement, thus reducing the opportunity for human error in aligning the patch. Thus there are fewer defective badges due to improper badge placement.

Figure 5C:
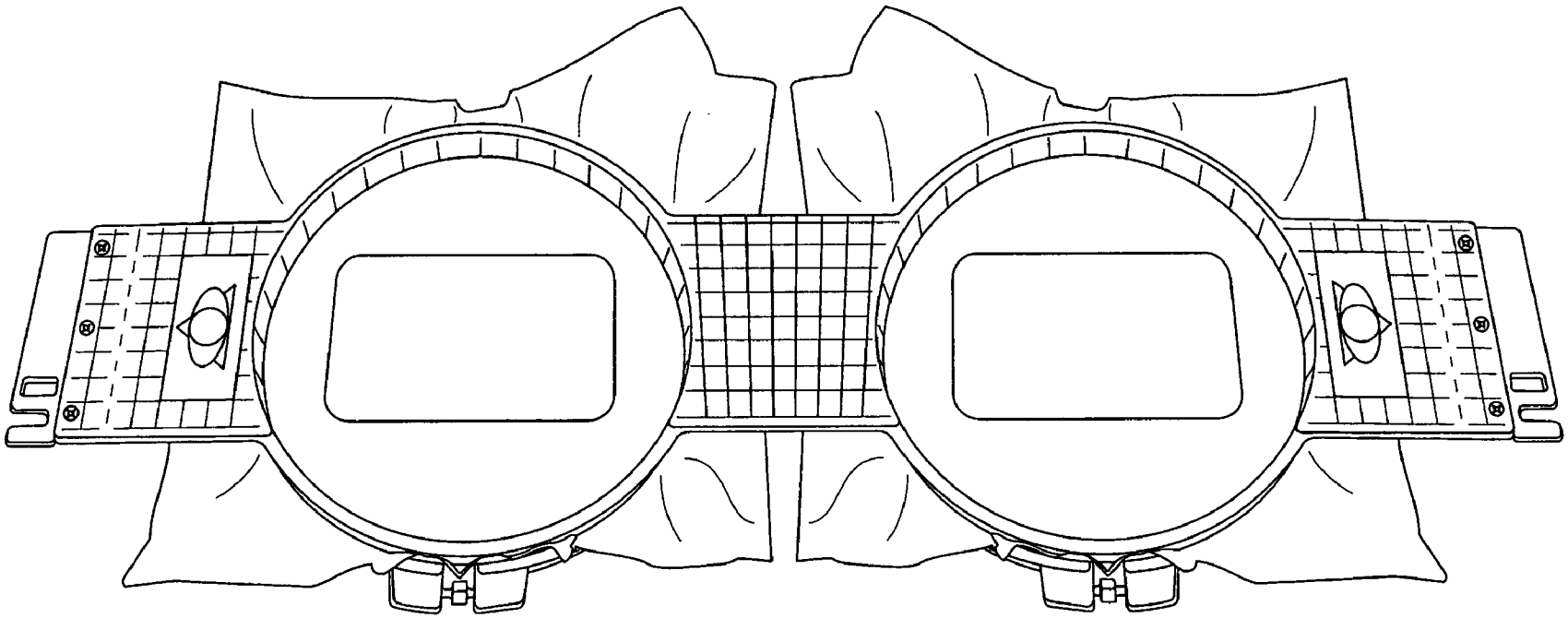
FIG. 5C shows patch placement holders positioned in a multi-hoop embroidery unit.

Because of the quick and easy placement of patches using the placement holder, the present invention allows for the efficient use of multiple hoops per embroidery head (see FIG. 5C). With multiple hoops, one hoop can be placed in the machine and run while the other is being set up, with no need to monitor the running hoop. When the embroidery design is complete the operator quickly removes one hoop and attaches the next hoop, thus simplifying the process.

The present invention also reduces the cost of digitizing the design. The design digitizing takes less time because the digitizer does not need to know the shape and size of the blank badge and does not need to program the outline running stitch into the design. Without these constraints, a single digitized design can easily be scaled to accommodate a wide range of size and shape of patches. The only thing that has to be incorporated into the digitized embroidery design is the placement of the lock stitches that initially secure the patch in place on the backing material. However, these lock stitches are incorporated under particular parts of the design, and as such, scale with the design according to the size of the patch in question. Therefore, the present invention can be used with any embroidery manufacturer's digitizing software or design format Another advantage of the present invention is the elimination of adhesive chemicals for securing the patches in place. This significantly reduces the cost of embroidering patches. Currently, adhesive spray retails for about $15.00 per 18 oz. can and self-adhesive backings sell for about $0.30 per square foot, verses the cost of the traditional tear-away backing used with the present invention, which costs about $0.08 per square foot. In addition to this direct cost savings, the invention also reduces the time and cost associated with needle replacements due to needles being clogged with chemical adhesive. Along those same lines, there is additional time saving due to fewer interruptions from thread breaks because the needles run cooler and cleaner without chemicals.

Since most of the adhesive sprays are also highly flammable, users must comply with several federal, state and local regulations regarding the shipment, storage and handling of these chemicals. The present invention allows businesses and operators to completely avoid this inconvenience and expense.

In addition to significant cost reduction, there are potential health benefits from avoiding chemicals that could be a cause of health problems. The present invention does not leave a sticky residue on badge, needles, employees, or equipment. With the level of concern regarding environmental pollutants and spiraling health costs concerns, any elimination of unnecessary chemicals from the workplace is welcome.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. An embroidery patch holder comprising:

(a) a frame that fits within an embroidery hoop used in an embroidery machine; and (b) at least one cutout section within said frame that matches the outline of a patch;

(c) wherein the patch holder holds a patch placed in the cutout section in alignment with the needles of the embroidery machine; and wherein the patch is held in place within said cutout section by locking stitches that secure the patch to a backing material placed within the embroidery hoop, wherein the locking stitches are incorporated into the embroidery design and are made first before the rest of the design is stitched into the patch.

2. The embroidery patch holder according to claim 1, wherein the patch holder is approximately the same thickness as the patch.

3. The embroidery patch holder according to claim 2, wherein the thickness of the patch holder is between 1 mm and 5 mm inclusive.

4. The embroidery patch holder according to claim 1, wherein the patch holder is made from one of the following materials:

plastic;
balsa wood;
plastic laminate;
engineered wood;
plexiglass;
polycarbonate thermoplastic resin;
rigid textile materials;
metal;
rubber;
high density polyethylene;
PVC;
PVC foamboard;
vinyl benzene; and
acrylic.

5. The embroidery patch holder according to claim 1, wherein said frame is manufactured as part of the embroidery hoop.

6. The embroidery patch holder according to claim 1 wherein the patch holder has indicator marks for indicating proper alignment of the holder with the embroidery hoop.

7. The embroidery patch holder according to claim 1, further comprising a locking mechanism that comprises pins mounted on the patch holder, wherein the pins are slid into holes in the embroidery hoop.

8. The embroidery patch holder according to claim 1, wherein the locking stitches can scale with the embroidery design.

9. The embroidery patch holder according to claim 1 wherein multiple patch holders can be used on multi-hoop embroidery machines, allowing embroidery multiple patches simultaneously.

10. The embroidery patch holder according to claim 1, wherein the patch holder can be used on both industrial and home embroidery machines.

11. The embroidery patch holder according to claim 1, wherein the patch holder can be used with any embroidery digitizing software and design format.

12. The embroidery patch holder according to claim 1, wherein component (b) further comprises multiple cut out sections.

13. The embroidery patch holder according to claim 1, further comprising a securing plate that fits over the frame (a) inside the embroidery hoop, comprising:

at least one cutout section that is the same shape as the cutout section in part (b), wherein the securing plate cutout section is smaller than the cutout section in part (b) such that the edge of the securing plate cutout section covers the edge of a patch placed in cutout section (b); and wherein magnets in both the securing plate and the frame (a) hold the securing plate in place against the frame (a).

14. The embroidery patch holder according to claim 13, wherein the edge of the securing plate cutout section covers 1 mm–3 mm, inclusive, of the edge of a patch placed in cutout section (b).

15. An embroidery patch holder comprising:

(a) a frame that fits within an embroidery hoop used in an embroidery machine;

(b) at least one cutout section within said frame that matches the outline of a patch;

(c) wherein the patch holder holds a patch placed in the cutout section in alignment with the needles of the embroidery machine; and (d) a locking mechanism that secures the patch to a backing material placed within the embroidery hoop, wherein the locking mechanism comprises tabs mounted on the patch holder that slide over the edges of the patch.

16. The embroidery patch holder according to claim 15, wherein the patch holder is approximately the same thickness as the patch, wherein the thickness of the patch holder is between 1 mm and 5 mm inclusive.

17. The embroidery patch holder according to claim 15, wherein the patch holder is made from one of the following materials:

plastic;
balsa wood;
plastic laminate;
engineered wood;
plexiglass;
polycarbonate thermoplastic resin;
rigid textile materials;
metal;
rubber;
high density polyethylene;
PVC;
PVC foamboard;
vinyl benzene; and
acrylic.

18. The embroidery patch holder according to claim 15, wherein said frame is manufactured as part of the embroidery hoop.

19. The embroidery patch holder according to claim 15, wherein the patch holder has indicator marks for indicating proper alignment of the holder with the embroidery hoop.

20. The embroidery patch holder according to claim 15, further comprising a locking mechanism that comprises pins mounted on the patch holder, wherein the pins are slid into holes in the embroidery hoop.

21. The embroidery patch holder according to claim 15, wherein multiple patch holders can be used on multi-hoop embroidery machines, allowing embroidery multiple patches simultaneously.

22. The embroidery patch holder according to claim 15, wherein the patch holder can be used on both industrial and home embroidery machines.

23. The embroidery patch holder according to claim 15, wherein the patch holder can be used with any embroidery digitizing software and design format.

24. The embroidery patch holder according to claim 15, wherein component (b) further comprises multiple cut out sections.

25. The embroidery patch holder according to claim 15, further comprising a securing plate that fits over the frame (a) inside the embroidery hoop, comprising:

at least one cutout section that is the same shape as the cutout section in part (b), wherein the securing plate cutout section is smaller than the cutout section in part (b) such that the edge of the securing plate cutout section covers the edge of a patch placed in cutout section (b); and wherein magnets in both the securing plate and the frame (a) hold the securing plate in place against the frame (a).

26. The embroidery patch holder according to claim 25, wherein the edge of the securing plate cutout section covers 1 mm–3 mm, inclusive, of the edge of a patch placed in cutout section (b).

* * * * *

UNITED STATES PATENT AND TRADEMARK OFFICE

CERTIFICATE OF CORRECTION

PATENT NO. : 7,194,967 B2
APPLICATION NO. : 11/142222
DATED : March 27, 2007
INVENTOR(S) : Monier Bowlus It is certified that error appears in the above-identified patent and that said Letters Patent is hereby corrected as shown below:

Column 4, line 3, after “made to fit” please change “and” to --any--

Signed and Sealed this

Twenty-sixth Day of June, 2007

JON W. DUDAS
*Director of the United States Patent and Trademark Office*